United States Patent [19]

Strahm et al.

[11] 4,269,046

[45] May 26, 1981

[54] EXTERNALLY HELD CYLINDRICAL SPREADING MEANS FOR TUBULAR FABRIC

[75] Inventors: Christian Strahm, Küsnacht, Switzerland; Fritz Gageur, Lindau-Bodolz, Fed. Rep. of Germany

[73] Assignee: Lindauer Dornier Gesellschaft mbH, Fed. Rep. of Germany

[21] Appl. No.: 92,100

[22] Filed: Nov. 7, 1979

[30] Foreign Application Priority Data

Nov. 8, 1978 [DE] Fed. Rep. of Germany ..... 2848409

[51] Int. Cl.[3] ..... D06F 29/00; D06C 5/00

[52] U.S. Cl. ..... 68/13 R; 26/85; 68/175; 264/40.2; 425/71; 425/135; 425/393

[58] Field of Search ..... 425/71, 72, 325, 135, 425/326.1, 392, 168, 393, 174; 26/85, 80–84, 51.5; 264/566, 40.2, 565, 569, 290.2, 292; 68/13 R, 175

[56] References Cited

U.S. PATENT DOCUMENTS

| | | | |
|---|---|---|---|
| 3,317,951 | 5/1967 | Hureau | 425/71 |
| 3,501,818 | 3/1970 | Heitkamp | 26/85 |
| 3,608,019 | 9/1971 | Kawasaki | 264/565 |
| 3,784,662 | 1/1974 | Hino et al. | 264/565 |
| 4,124,350 | 11/1978 | Mercer | 264/292 |

FOREIGN PATENT DOCUMENTS

| | | |
|---|---|---|
| 466211 | 9/1928 | Fed. Rep. of Germany . |
| 1277189 | 9/1968 | Fed. Rep. of Germany . |
| 1460592 | 4/1969 | Fed. Rep. of Germany . |
| 1949543 | 4/1971 | Fed. Rep. of Germany . |
| 1635281 | 6/1971 | Fed. Rep. of Germany . |

*Primary Examiner*—Jeffery R. Thurlow
*Attorney, Agent, or Firm*—James E. Bryan

[57] ABSTRACT

This invention relates to an improvement in an externally held cylindrical spreading means for tubular material, particularly for the treatment of the material with a fluid treating agent, with a central carrier for radially displaceable supports and segment-like guide elements carried by the supports, the improvement comprising body means at each end of the central carrier, each of said body means being tapered in the longitudinal direction, said guide elements extending in the longitudinal direction of said spreading means between said body means, and supporting and transporting roller means mounted against the exterior of said body means, said roller means having a profile adapted to the form of said tapered body means.

15 Claims, 5 Drawing Figures

EXTERNALLY HELD CYLINDRICAL SPREADING MEANS FOR TUBULAR FABRIC

The present invention relates to an externally held cylindrical spreading means for tubular fabric with a central carrier for radially displaceable supports which are adapted to be spread, and with segment-like guide elements carried by the supports.

Spreading means are known in various construction. One of their essential characteristics is that they contain guide elements which are adapted to be outwardly spread and, from the inside, will come to rest against the tubular fabric, thus spreading and stretching it. From the outside, counter-rollers will come to be positioned into recesses of the spreading means, whereby the spreading means is held in a suspended fashion.

Generally speaking, the spreading devices are constructed so as to be flat. Thus, known from German Offenlegungsschrift No. 1,635,281, is a steam-fixing machine for mesh material in hose or tubular form, which contains a suspended spreading means or device. The spreading device consists of two skids over which the hose or tubular material is pulled. These skids have recesses with two each inserted narrow rollers, whereby one counter-roller each comes to be positioned from the outside between the two rollers and thus holds the spreading means in a suspended position. During the feed of the material, the friction between the skids and the material, which is not negligible, must be overcome. The tubular or hose material is here held in a flat manner corresponding to the thickness of the skids.

In another known spreading device, for example according to German Offenlegungsschrift No. 1,949,543, there are provided, instead of the skids, two parallel carriers which may be spread or forced apart by way of parallel guides. In this case, the material is pulled not over the skids or carriers themselves, but rather—for the purpose of reducing the friction—over rotatable rollers which are distributed on the carrier. An endless conveyor belt also may be placed over the row of rollers. This particular spreading device is also held in a suspended position by means of external counter-rollers.

All of these flat spreading means or devices have disadvantages if the hose or tubular material is treated with liquid, for example mercerized. The narrow skids and rollers and the counter-rollers supported thereagainst from the outside will leave—due to the necessary contact pressure thereof—stripe-like traces on the wet material which will greatly impair the appearance of the material.

Also known in the art are spreading means which do not stretch and flatten in only one plane but which operate in several stretching planes, i.e. which widen spatially. For example, shown in German Auslegeschrift No. 1,277,189, and in German Offenlegungsschrift No. 1,460,592, are devices in which reversing rollers provided in a circular manner are equipped with endless tie rods or tension members placed thereupon. The tie rods or tension members extend with the hose or tubular material in the longitudinal direction of the machine and will thereby come to be placed from the inside against the hose or tubular material. Here again there are supporting rollers present being positioned outside of the material which bring about the same adverse effect mentioned hereinabove.

A different known type of spreading means is described in German Pat. No. 466,211. What is disclosed in this case in a drying rack for hose or tubular material in which individual tension rings are subdivided into segments and these segments are made into expandable rings by means of sprial springs placed thereover. The individual segments are displaceable by means of scissor-like adjusting arms. Several such expandable rings with the adjusting arms thereof are disposed on a central spindle by way of displaceable sleeves, and form a drying rack adaptable to the diameter of the hose or tubular material, in which drying rack the material is pulled, for the purpose of drying, over the individual ring-shaped spiral springs. It is possible to provide, between the individual rings, connecting bars in the axial direction, which bars serve only for reinforcing, but not for guiding the material. Such a spreading means, however, is not suitable for the continuous feed of tubular or hose material, particularly not if the material is intended to be treated with a liquid, and moreover it cannot be held in a suspended position from without.

Starting from a spreading means of the type last mentioned above, it is the object of the present invention to improve the guide of the hose or tubular material over the spreading means, particularly the widening of the material during the running-in thereof, whereby care is taken to avoid higher surface pressures due to the supporting and transporting rollers maintaining the spreading means in its suspended position.

This object is obtained, according to the present invention, by virtue of the fact that disposed at the ends of the central carrier as a running-in and a running-out part is in each case a body tapered in the longitudinal direction and against which supporting and transporting rollers come to rest from without; that the guide elements extend in the longitudinal direction of the spreading means between the two bodies, and that the supporting and transporting rollers have a profile adapted to the form or shape of the tapered body.

Due to the specific design of the supporting and transporting rollers, higher surface pressures and stripe-like traces of the heretofore customary narrow counter-rollers are effectively eliminated. This advantage is particularly noticeable and apparent when the material, after a liquid treatment, is wet or damp.

The guide elements are advantageously provided as parts of a circular cylinder jacket, and the bodies as truncated cones. For the treatment of the hose or tubular material it may be of advantage that at least a portion of the spreading means or device is immersed into a bath of the treating liquid and that the immersable truncated cone-like body is floatable.

For the treatment of the material with liquid, it is advantageous that in at least the part of the guide elements subjected to the liquid treatment and in the surface thereof there are provided wave-like formations in the manner of a grooving or corrugation, extending transversely to the transporting or feeding direction of the material. The undulatory formations of the surface of the guide elements render possible a perfect action of the treating medium upon the hose or tubular material from both sides, and particularly faciliate also the transport or feeding of the material along the spreading means so that a smaller surface pressure is required for the supporting and transporting or feeding rollers which, in turn, leaves fewer traces on the material. A further improvement is achieved by the co-action of the undulation or corrugation with nozzles disposed outside of the spreading means and in a circular manner therearound for the treating medium. This effect is particularly favorable when the spraying direction of the nozzles is oriented essentially against the wave troughs of the grooving or corrugation.

A spreading means according to the present invention may be used either singly or in combination, for example two successive spreading means in one treating unit. It is suitable for several types of treatment with a liquid, for example for mercerizing or leaching, or also for washing and rinsing of the lye. Dyeing is equally possible. Finally, for example at the outlet part of a spreading means or device in a washing unit, a ring of nozzles also may be provided with—instead of a treating liquid—blows out or suctions in air, thus making drying possible. Furthermore, the spreading means also may be employed for visual purposes, or for checking the hose or tubular material, in that, for instance, an optical scanning may take place for sources of errors, in which case light is directed toward the material from without and wherein light-sensitive scanning devices are disposed at the interior of the material, which devices are responsive to changes in the light passage and emit an error signal. The light-sensitive elements thereby may be embedded in the surface of the guide elements.

One embodiment of the present invention will be further described hereinafter and explained with reference to the accompanying drawings, wherein FIG. 1 illustrates the arrangement of the spreading means within a treating unit;

Figure 1:
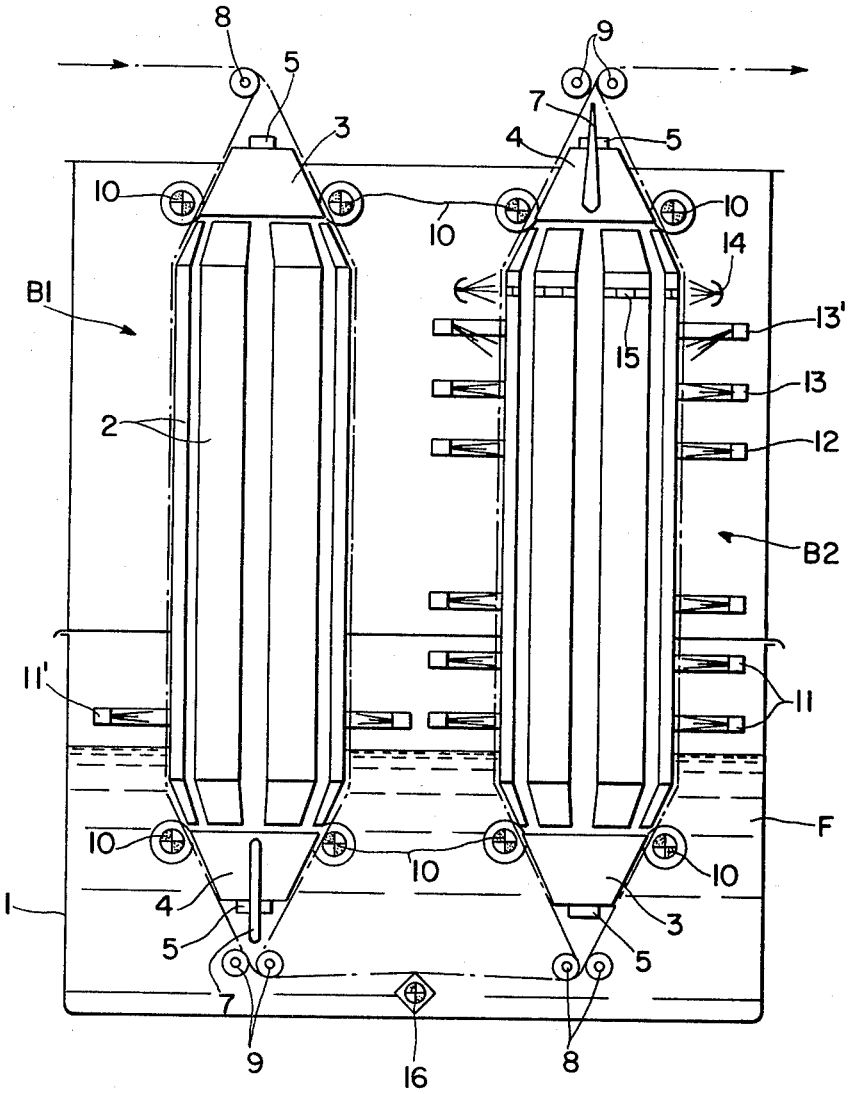

Represented in FIG. 1 is an overview of the arrangement and use of the inventive spreading means. The representation thereof is purely by way of example because, depending upon the respective type of treatment, either one or the other spreading means is usable alone, or the spreading means is also usable in combination. Shown in this case is the arrangement of two spreading means or devices B1 and B2 in one treating unit. Both spreading means are inserted into a container 1. The material path or course is indicated in dash-dotted lines and provided with arrows. The material runs initially over the driven supply roll 8, and thereafter over the spreading means B1 downwardly to the freely rotating pair of outlet rolls 9. It is then further guided to the freely rotating pair of inlet rolls 8 of the spreading means B2, and from there runs, over the spreading means B2 upwardly to the freely rotating pair of outlet rolls 9.

The construction of the two spreading means B1 and B2 will be explained hereinafter in general terms. Both have truncated cone-shaped inlet parts 3 and the same type of outlet parts 4. The carrier part connecting the inlet and outlet parts has not been shown in either case. It will be explained hereinafter in connection with FIGS. 2–4. Between the inlet part 3 and the outlet part 4 there extend in each case the guide elements 2. They form, practically, parts of a cylindrical jacket. At the upper and lower ends thereof they extend in an inclined fashion, and this inclination corresponds approximately to the inclination of the truncated cone-shaped inlet and outlet parts 3 and 4. The spreading means are carried in each case by supporting and transporting or feeding rollers 10 being rigidly positioned on the machine. These supporting and transporting rollers are positioned in each case externally against the truncated cone-shaped elements 3 and 4. Driven by the supporting and transporting rollers 10 are at least the pairs of rolls resting against the outlet parts 4 and transport the material over the path thereof indicated in dash-dotted lines over the spreading means. The two spreading means are surrounded by spraying nozzles 11 in a circular fashion in one or several planes. The spraying direction is oriented against the spreading means and is shown in the drawing.

Initially, the spreading means B1 alone is to be considered and is conceived, for example, for the use thereof during leaching under tension. At that time the spreading means B1 is immersed into a liquid bath F within the container 1. Indicated above the liquid level in a circular fashion are the spraying nozzles 11' from which a treating liquid is sprayed against the material. The transporting direction of the material extends downwardly and, accordingly, not only the weight of the spreading means B1 but also the traction of the material will act upon the lower supporting and transporting rollers 10, thereby increasing the contact pressure there. Remedial action is provided for in that, as will be further explained hereinafter, the truncated cone-shaped outlet part 4 is a floatable body which produces an uplift thereby relieving the load from the joints of the supporting and transporting rollers 10. Because at the end of the spreading means B1 the material is further fed in a flat manner over the outlet roll 9, spreading swords 7 are shown here.

Next, the spreading means B2 alone is to be considered on the basis of an example of a washing plant. It also is immersed into a treating liquid F and is also floatable. The floatability, however, does not play as important a role in this case as in connection with the spreading means B1 because—due to the upward direction of the material transport or supply—there does exist a certain amount of relief for the contact pressure at the lower supporting and transporting rolls 10. The spreading means B2 is surrounded in several planes by spraying nozzles 11 disposed in a circular fashion. In this case the lower spraying nozzles 11 are driven chiefly with pump liquid from the bath F, for example with water in the case of a washing plant. In higher-positioned planes, for example in the case of the spraying nozzles 12, fresh water is sprayed against the hose material instead of pump liquid. Still farther up toward the outlet part of the spreading means B2, additional nozzle rings 13 and 13' are provided. Instead of liquid, air is blown out or, if desired, suctioned in from these nozzles. In the present example it is assumed that air is initially blown through the nozzles 13 against the material and that subsequently a suctioning in takes place through the nozzles 13'. It is indicated in the drawing that the direction of action of the suction nozzles 13' is slightly inclined with respect to the transporting direction of the material, in contrast to the blast nozzles 13 blowing vertically thereagainst. The nozzle rings are advantageously subdivided and provided so that they can be folded up.

Liquid nozzles and air nozzles need not be used jointly; rather, their use is possible also individually or in any desired combinations. The spreading means thus are likewise usable not only for the liquid treatment proper, but also for drying. Another type of use therefor is indicated in FIG. 1 also for the spreading means B2. Shown in this case is an advantageous use for visual or checking purposes. The spread-out hose or tubular material is optically scanned in this case. For this purpose, light sources 14 are positioned in a circular manner outside of the spreading means, and provided on the spreading means itself—for example embedded into the surface of the guide elements 2—are light-sensitive scanning devices 15. Changes in the light passage indicate defects in the material and emit an error signal. Such optical or electrical devices per se are not, however, part of the present invention.

A beater roll 16 possibly may be additionally arranged in the container 1 between the two spreading means B1 and B2, if such should be required.

Figure 2:
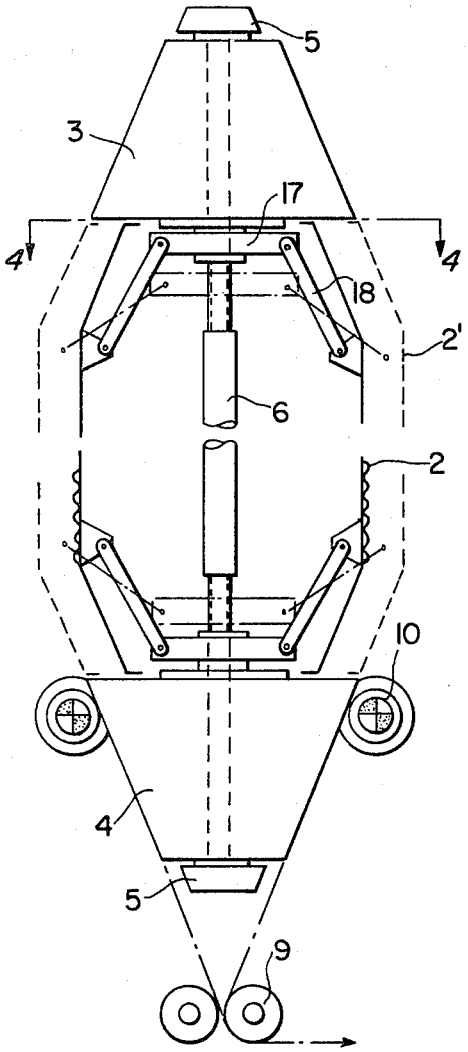
FIG. 2 illustrates the construction of such a spreading means, partially in a longitudinal cross-section thereof.

The construction of a spreading means will now be described based on FIGS. 2, 3, and 4. The spreading means parts, as shown, correspond—with reference to the transporting direction of the material—to the parts of the spreading means B1 in FIG. 1. FIG. 2 illustrates—partially in a longitudinal cross-sectional view—the construction of the spreading means. Positioned at the end of a central carrier 6, which is here provided as a tube, are the truncated cone-shaped inlet elements 3 and outlet elements 4. Furthermore, seated at the ends of the carrier 6 at the top and at the bottom thereof are final elements 5 which may be provided, for example, as handwheels and allow for a turning of the carrier 6. The carrier 6 is equipped at the top and bottom with an oppositely-directed thread. Disposed on these threads are the threaded sleeves 17 in such a manner that, by a turning of the carrier 6, the threaded sleeves may either be brought closer to each other, or separated from each other. From the threaded sleeves 17 there extend the supporting levers 18 obliquely radially outwardly to the guide elements 2 of the separating means. By an adjustment of the threaded sleeves 17 with the supports 18 from the position shown in full lines into the position shown in dash-dotted lines, the guide elements 2 are equally shifted radially outwardly into the position shown in dash-dotted lines, and the spreading means is thereby opened up or widened and adapted to the diameter of the hose or tubular material. Indicated in the lower part of the guide elements 2 in FIG. 2 is also the undulation or corrugation of the surface of the guide elements. The corrugation is so made that the wave troughs extend transversely to the transporting direction of the material. As has been set forth already hereinabove, this corrugation effectively brings about a flawless treatment of the material with liquid, and moreover an easy transport of the material is guaranteed. The corrugation may be advantageous also for the drying action.

Figure 4:
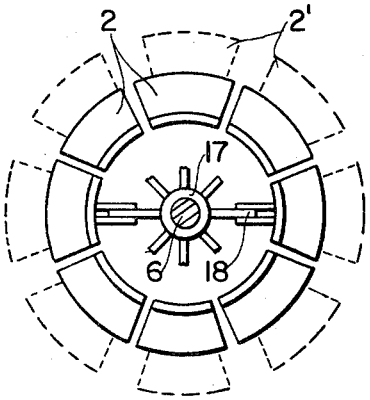
FIG. 4 is a top plan view of FIG. 2, after the removal of the upper inlet part.

FIG. 4 is a top plan view of FIG. 2 in a cross-section of the intersecting line 4—4. It is apparent therefrom that the guide elements 2 are segments of a circular cylindrical jacket surface, and that they can be moved radially outwardly into the position 2', shown in dash-dotted lines, with the aid of the sleeve 17 being displaceable on the carrier 6 and with the aid of the supports 18. The guide elements 2 have at the upper and lower ends thereof an inclination which corresponds approximately to the inclination of the truncated cone-shaped elements 3 and 4.

Figure 3:
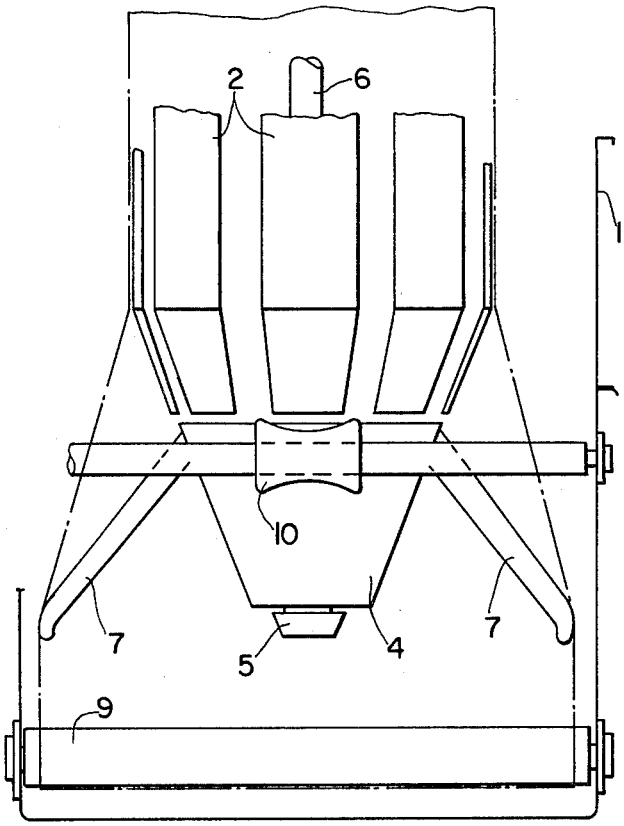
FIG. 3 is a lateral view of FIG. 2.

FIG. 3 is a side view of FIG. 2. In this case the guide elements 2 are shown in the expanded position thereof. The transition from the guide elements 2 to the outlet part 4 is here particularly apparent. As the juxta-positioned FIGS. 2 and 3 show, the outlet part 4 is carried by the supporting and transporting rollers 10. It is clearly apparent from FIG. 3 that the supporting roller 10 has a special profile which is adapted to the curvature of the outlet part 4. Achieved in this manner is a large contact surface for the transporting rollers 10. Complementary to the arrangement of the supporting and transporting rollers 10, in the example shown herein are merely two axes with rollers being parallel to each other; however, an arrangement of three rollers with axes each being offset about 60° with respect to each other, or the use of two pairs of rollers with axes intersecting each other at a right angle are equally useful. Further shown in FIG. 3 in dash-dotted lines is the path of the material. It is apparent in this case that the material is further conveyed, after the widened area, in a flat manner over the outlet roll 9. In order to flawlessly guide this transition from the expanded to the flat areas, widening swords 7 are disposed within the outlet body 4, which—being positioned opposite each other—spread the material outwardly.

Figure 5:
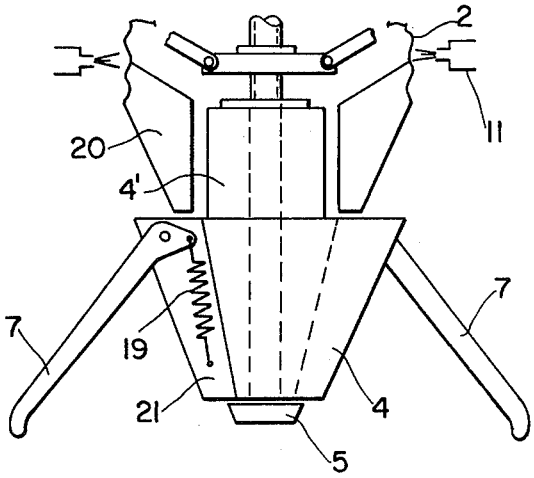
FIG. 5 illustrates details of the lower outlet part of FIG. 3.

Indicated in FIG. 5 is once again the outlet body 4 which, as has been mentioned hereinabove, is floatable. The outlet body 4 has diagonally oppositely-positioned notches 21 into which the spreading swords 7 are pivotally inserted. A spreading spring 19 biases the spreading swords 7 in each case from the inside against the hose or tubular material, thus assuring the flattening thereof. In case the buoyancy achievable by means of the outlet body 4 as a result of the floatable construction thereof within the liquid bath should not be sufficient, this buoyancy may be increased by means of a further inwardly projecting additional element 4' which is also floatable. In this connection it is possible to fabricate the outlet body 4 and the additional element 4' of one piece, or to compose them of separate parts. It is further possible also to further provide structural parts being immersed into the bath, namely to provide the lower ends of the guide elements 2 as buoyant elements. Such a buoyant body is shown at reference numeral 20 in FIG. 5. Further shown in FIG. 5 is also the position of spraying nozzles 11 opposite the wave troughs of the corrugation. The treating liquid is sprayed into the wave trough through the material stretched over the wave trough.

The present invention is not limited to the construction shown in the present embodiment; rather, various modifications thereof are possible. For example, it is not mandatory that the guide elements 2 be provided absolutely continuously between the inlet part 3 and the outlet part 4; for, if necessary, they may be subdivided into separate upper and lower parts, whereby each part has its own spreading device. Outside of the circular-shaped gap formed by the two parts it is possible to provide a ring of spraying nozzles, whereby the spraying direction is directed against the gap in precisely the same manner as against a wave trough. If necessary, the guide elements of the parts positioned above the gap and the parts positioned below the gap may be turned against each other about an angle in the circumferential direction of the spreading means so that the upper parts will be positioned at a gap with respect to the lower parts.

It will be obvious to those skilled in the art that many modifications may be made within the scope of the present invention without departing from the spirit thereof, and the invention includes all such modifications.

What is claimed is:

1. In an externally held cylindrical spreading means for tubular fabric material, particularly for the treatment of the material with a fluid treating agent, with a central carrier for radially displaceable supports and segment-like guide elements carried by the supports, the improvement comprising body means at each end of the central carrier, each of said body means being tapered in the longitudinal direction, said guide elements extending in the longitudinal direction of said spreading means between said body means, and supporting and transporting roller means mounted against the exterior of said body means, said roller means having a profile adapted to the form of said tapered body means.

2. A spreading means according to claim 1 in which said guide elements are parts of a circular cylindrical jacket and said body means are truncated cones.

3. A spreading means according to claim 1 including a bath of treating fluid into which at least a part of said spreading means is immersed, with immersed body means being buoyant.

4. A spreading means according to claim 1 including undulating formations, extending transversely to the transport direction of the material, on at least a portion of the surface of said guide elements.

5. A spreading means according to claim 2 including angled ends on said guide elements adapted to the form of the truncated cones.

6. A spreading means according to claim 3 including means whereby a part of said guide elements immersed in said treating fluid liquid is buoyant.

7. A spreading means according to claim 2 including two oppositely positioned resilient sword means in a truncated cone at a discharge end of said spreading means.

8. A spreading means according to claim 1 including at least one ring of nozzles, for the discharge of a treating medium, surrounding said spreading means.

9. A spreading means according to claim 8 in which said nozzles are directed against wave troughs of undulating formations, extending transversely to the transport direction of the material, on the surface of said guide elements.

10. A spreading means according to claim 1 including a plurality of spreading means combined into one treating unit.

11. A spreading means according to claim 10 including, in proximity to an outlet part of a last spreading means, air discharge nozzles directed against said guide elements.

12. A spreading means according to claim 11 including suctioning-off nozzles downstream of said discharge nozzles in the transport direction of said material.

13. A spreading means according to claim 10 including a bath of treating fluid into which at least a part of said treating unit is immersed and beater roll means in said bath between spreading means.

14. A spreading means according to claim 1 including light source means on one side of said material and directed toward and transversely to the transporting direction of said tubular material over said spreading means, light-sensitive scanning means on the other side of said tubular material for scanning any variations in light passage through said material, and defect-indicating means connected to said scanning means and adapted to emit a defect signal upon occurrence of a change in light passage.

15. A spreading means according to claim 14 in which said scanning means is embedded in the outer surface of said guide elements.

* * * * *